US006820700B2

(12) United States Patent
Fünfer et al.

(10) Patent No.: US 6,820,700 B2
(45) Date of Patent: Nov. 23, 2004

(54) CHUCK FOR A PERCUSSION TOOL

(75) Inventors: Josef Fünfer, Königsbrunn (DE); Michael Schamberger, Scheuring (DE); Jens Frenzel, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 55 days.

(21) Appl. No.: 10/310,094

(22) Filed: Dec. 4, 2002

(65) Prior Publication Data

US 2003/0116334 A1 Jun. 26, 2003

(30) Foreign Application Priority Data

Dec. 21, 2001 (DE) ..... 101 63 176

(51) Int. Cl.[7] ..... B25D 17/08

(52) U.S. Cl. ..... 173/132; 279/19.3; 279/19.6; 279/75; 279/156

(58) Field of Search ..... 173/132, 128, 173/29; 279/19.3, 19.4, 19.5, 19.6, 75, 81, 156

(56) References Cited

U.S. PATENT DOCUMENTS 5,199,833 A * 4/1993 Fehrle et al. ..... 408/239 R
5,603,516 A * 2/1997 Neumaier ..... 279/19.5
6,241,026 B1 * 6/2001 Wache et al. ..... 173/132
6,497,418 B2 * 12/2002 Yahagi ..... 279/19.4

FOREIGN PATENT DOCUMENTS

| | | |
|---|---|---|
| DE | 3421811 | 12/1985 |
| DE | 3634285 | 4/1988 |
| DE | 3638215 | 5/1988 |
| DE | 0105250 | 9/2001 |
| GB | 1291475 | 10/1972 |

* cited by examiner

*Primary Examiner*—Eugene Kim
*Assistant Examiner*—Thanh Truong
(74) *Attorney, Agent, or Firm*—Sidley Austin Brown, Woods, LLP

(57) ABSTRACT

A chuck for a rotary-percussion power tool (2) and including a working tool guide (3) for receiving a shank (5) of a working tool, at least one locking member (4) for limiting an axial displacement of the shank (5) within an axial displacement length (X) from opposite sides, and a displaceable, spring-biased stop member (7) cooperating, within the shank displacement length (X), with a power tool side, stop surface (8) of the shank (5).

11 Claims, 2 Drawing Sheets

CHUCK FOR A PERCUSSION TOOL

BACKGROUND OF THE INVENTION

1. Field of the Invention

The present invention relates to a chuck for a percussion tool such as, e.g., a hammer drill for receiving a working tool with a possibility of a limited axial displacement of the working tool within the chuck.

2. Description of the Prior Art

The chucks of the type described above have a working tool guide with radial guiding inner surfaces within which a shank of a working tool and the diameter of which corresponds to the inner diameter of the guide inner surfaces, is received with a possibility of a limited axial displacement. The axial displacement of the working tool, i.e., of the shank is limited from opposite sides by at least one rigid locking member which is axially secured in the chuck and engages in a radial outer locking groove provided in the shank and axially limited at its opposite sides. The chuck further usually includes at least one, projecting radially inwardly entraining web that engages in an associated, open at one of its axial ends, entrain groove formed in the shank.

German Publication DE-106 0 283 A1 discloses a chuck the locking members of which are formed by two, axially spaced, radially displaceable balls which are displaced between a radially outwardly release position and a locking position by two respective annular sleeves which are actuated by a common locking sleeve. The two locking members, which are formlockingly displaced by rotation of the locking sleeve, provided a combination chuck for different shank systems.

German Publication DE-44 00 779 A1 discloses a percussion power tool in which there is provided for the anvil which impacts an end surface of a working tool, a socket element formed as frictionally, axially displaceable sleeve in which the anvil is arranged with a possibility of a limited axial displacement. When a idle impact takes place, i.e., when the tip of the working tool does not contact a workpiece, the socket element is displaced axially forward and is frictionally retained in the idle stroke position outside of the impact region of the percussion piston. When the working tool engages the workpiece, the socket element, together with the anvil, is displaced again into its operational position within the impact region of the percussion piston. In the power tool of DE-44 00 779 A1, the prevention of an undesirable idle impact takes place within the percussion power tool itself.

An object of the present invention is to provide a chuck for a percussion power tool which would prevent the transmission of an idle impact of the power tool to the working tool.

Another object of the present invention is to provide a chuck for a percussion power tool which would prevent idle impacts in the power tool with an idle impact suppression, which could deactivate the idle impact suppression means within the power tool, particularly, when a heavy working tool is used and which is oriented vertically upward, as in this case, the gravity force of the working tool, deactivates the idle impact suppression means within the tool.

SUMMARY OF THE INVENTION

These and other objects of the present invention, which will become apparent hereinafter, are achieved by providing a chuck including at least one locking member for limiting an axial displacement of the shank to an axial displacement length from opposite sides, a displaceable stop member cooperating, within the shank displacement length, with a power tool side, stop surface of the shank, and al spring for biasing the stop member into engagement with the stop surface of the shank.

The displaceable stop member, which cooperates with the shank stop surface, additionally limits the displacement length of the shank to a partial length region which includes the front dead point so that the working tool occupies, with respect to the chuck, an idle impact position that is outside of the operational point of the power tool anvil. In this position, no impact is transmitted to the working tool during idle strokes of the power tool. Thus, even heavy working tools do not act on the idle stroke suppression means within the power tool.

Advantageously, the stop surface of the shank is formed by a portion of a power tool side, end surface of the shank. Thereby, conventional working tools having a shank associated with a specific chuck, can be used.

Advantageously, the stop member is arranged on a power tool side of the locking member in an axially spaced relationship relative thereto. This permits to form the stop surface or the power tool side, end surface of the shank.

Advantageously, the stop member is displaced in a radial direction against a biasing force of the spring between an inner radial stop formed by the working tool guide and facing a guide inner surface of the guide, with the inner radial stop formlockingly cooperating with the stop member, and an outer radial stop formed by the spring and which forcelockingly cooperates with the stop member. The inner and outer stops prevent the stop member from falling out, while the inner guide surface provides for positioning of the stop member.

Advantageously, the stop member is formed as a hardened ball having a diameter smaller than the locking member which, likewise, is formed as a ball. The smaller ball occupies less space. Further the ball-shaped stop member provides for a torsion-free point contact.

Advantageously, the stop member biasing spring is displaced, at least partially together with the locking member, and the chuck further comprises a manually displaceable, from outside, locking sleeve for displacing the spring, with the locking sleeve being displaceable axially or rotatably. The use of the locking sleeve permits to release and unlock the working tool in a single step. Thereby a user needs not to overcome the biasing force of the stop member-biasing spring when changing the working tools.

Advantageously, the spring has a radially outwardly extending cup that provides space for a free displacement of the stop member radially outwardly.

Advantageously, the stop member-biasing spring is formed as a ring spring that surrounds the stop member and is preloaded radially inwardly, with the ring forces providing for preloading of the spring.

Advantageously, the spring is supported, at least partially, on a cylindrical guide surface of the working tool guide which provides for a pivotal support of the spring.

Advantageously, the spring forms an axially projecting entraining hook formlockingly engageable in a recess of the at least partially pivotally displaceable, locking sleeve for joint rotation therewith. This permits to combine the stop member-biasing spring with the locking sleeve.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiment when read with reference to the accompanying drawings.

DETAILED DESCRIPTION OF THE PREFERRED EMBODIMENT

Figure 1:
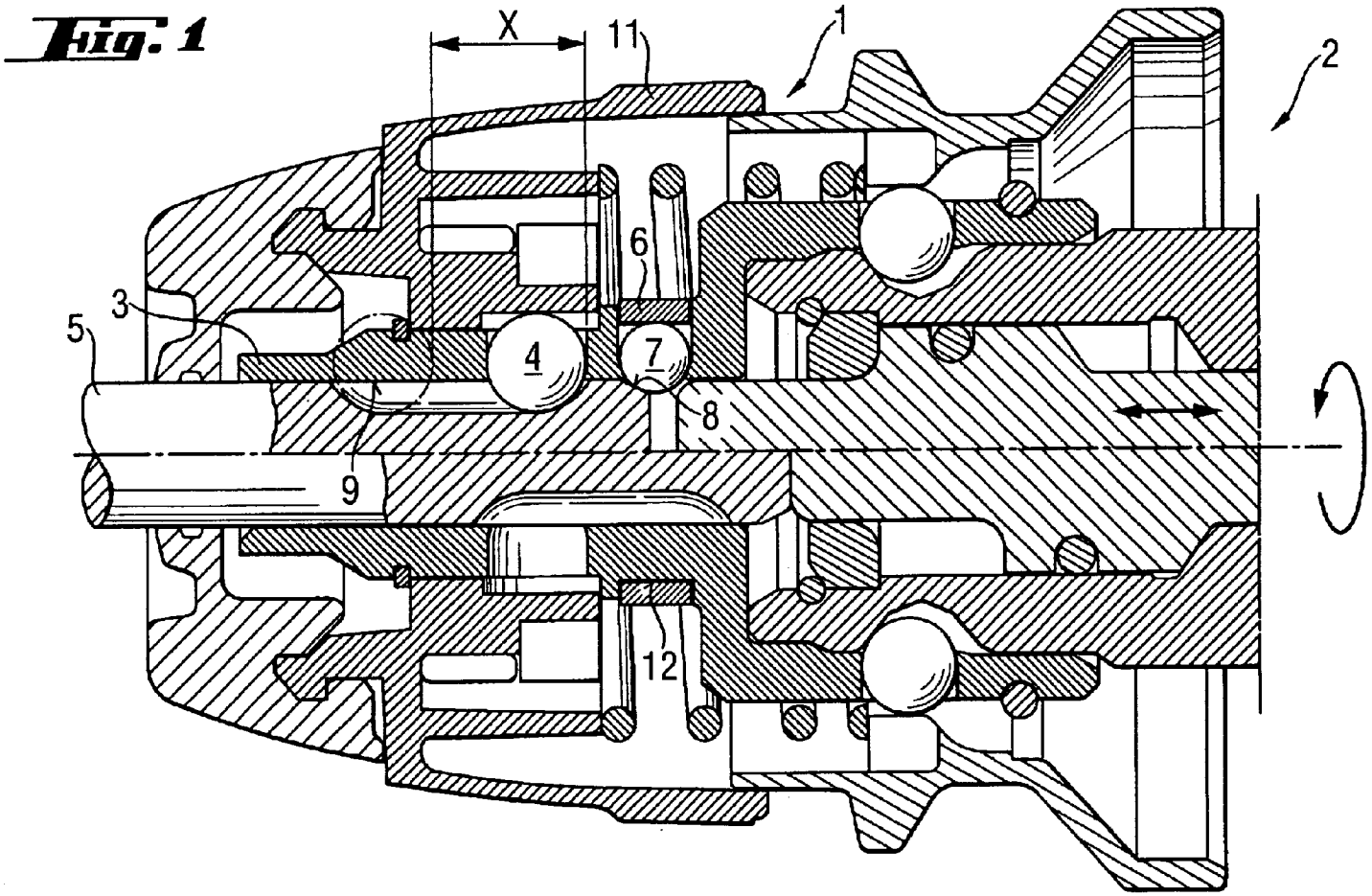
FIG. 1 a longitudinal cross-sectional view of a chuck according to the present invention.
Figure 2:
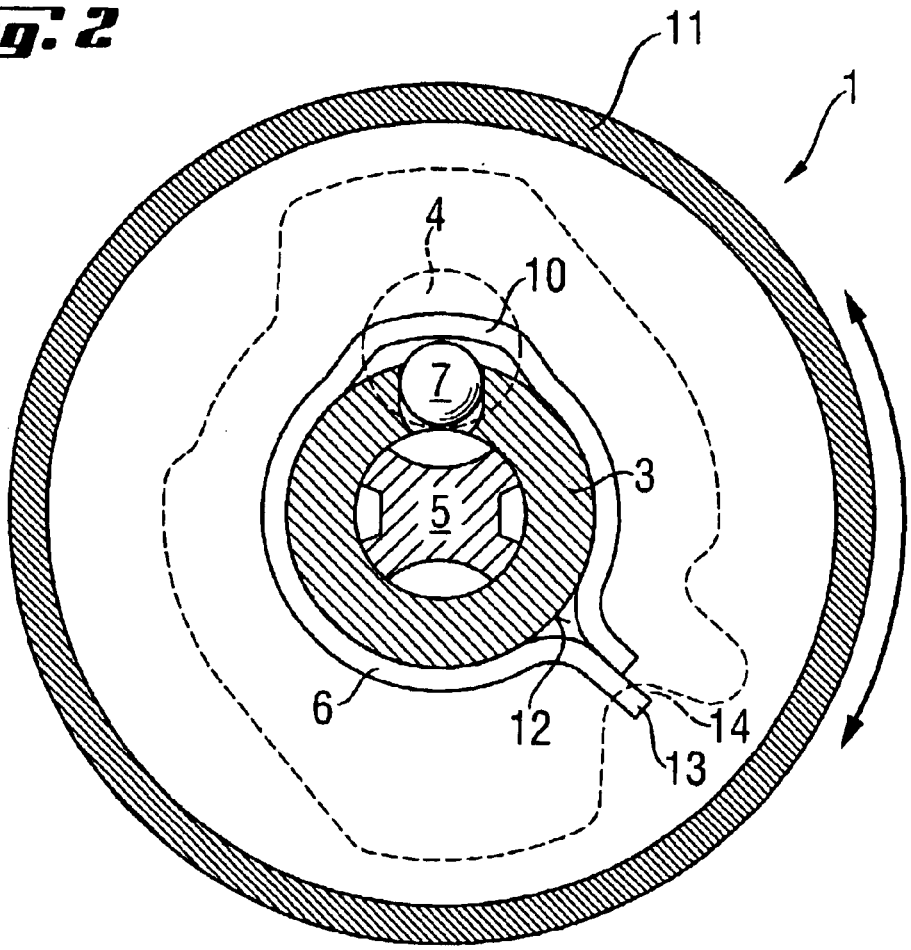
FIG. 2 a transverse cross-sectional view of the inventive chuck.

FIGS. 1–2 show a tool chuck (1) according to the present invention for a rotary-percussion power tool (2) shown only partially. In FIG. 1, the upper portion of the drawing shows the condition of the chuck (1) in the idle stoke position of the rotary-percussion power tool (2), and the lower portion of the drawings shows the condition of the chuck (1) in the operational position of the rotary-percussion power tool (2). The chuck (1) has a working tool guide (3) and a locking member (4) for limiting an axial displacement of a shank (5) of a working tool within a limited axial displacement length (X) of the shank (5). The chuck (1) further includes a stop member (7) spaced from the locking member (4) in the axial direction and provided on a power tool side of the locking member (4). The stop member (7) cooperated with a stop surface (8) of the shank (5) and which is provided at the end side of the shank (5) facing in the direction opposite the operational direction of the power tool (2). The stop member (7) is radially displaceable with respect to the shank (5) against a biasing force of a spring (6).

The locking member (4) is formed as a ball-shaped member. The stop member (7) is likewise formed as a ball-shaped member but with a diameter smaller than the locking ball-shaped member (4). The radial displacement path of the stop member (7) is limited by an inner radial stop formed in the working tool guide (3) and facing the guide inner surface (9) of the working tool guide (3), and by an outer radial stop formed by the spring (6). The stop member (7) formlockingly engages the inner radial stop and forcelockingly engages the upper radial stop.

As shown in FIG. 2, which shows a release position of the chuck (1), the spring (6) is formed as a ring spring and is formed with an extending radially outwardly, cup (10) that provides space for displacement of the stop member (7) radially outwardly. In the release position of the chuck (1), the spring (6), together with the locking member (4), is displaced upon actuation of a locking sleeve (11). The locking sleeve (11) is displaced by being pivoted manually from outside. The ring-shaped spring (6) is partially supported on a cylindrical outer guide surface (12) of the working tool guide (3) and forms an axially projecting entraining hook (13) which formlockingly engages in a recess (14) of the pivotal locking sleeve (11) for joint rotation therewith.

Though the present invention was shown and described with references to the preferred embodiment, such is merely illustrative of the present invention and are not to be construed as a limitation thereof and various modifications of the present invention will be apparent to those skilled in the art. It is therefore not intended that the present invention be limited to the disclosed embodiment or details thereof, and the present invention includes all variations and/or alternative embodiment within the spirit and scope of the present invention as defined by the appended claims.

What is claimed:

1. A chuck for a rotary-percussion power tool (2), comprising a working tool guide (3) for receiving a shank (5) of a working tool; at least one locking member (4) for limiting an axial displacement of the shank (5) in opposite directions within an axial displacement length (X); a displaceable stop member (7) cooperating, within the shank displacement length (X), with a power tool side, stop surface (8) of the shank (5); and a spring (6) for biasing the stop member (7) into engagement with the stop surface (8) of the shank (5) and having a radially outwardly extending cup (10) that provides space for displacement of the stop member (7) radially outwardly.

2. A chuck according to claim 1, wherein the stop surface (8) of the shank (5) is formed by a portion of a power tool side, end surface of the shank (5).

3. A chuck according to claim 1, wherein the stop member (7) is arranged on a power tool side of the locking member (4) in an axially spaced relationship relative thereto.

4. A chuck according to claim 1, wherein the stop member (7) is displaced in a radial direction against a biasing force of the spring (6).

5. A chuck according to claim 4, wherein the stop member (7) is radially displaceable between an inner radial stop formed by the working tool guide (3) and facing a guide inner surface (9) of the guide (3) and formlockingly cooperating with the stop member (7), and an outer radial stop formed by the spring (6) and forcelockingly cooperating with the stop member (7).

6. A chuck according to claim 1, wherein the stop-member (7) is formed as a ball.

7. A chuck according to claim 1, wherein the spring (6) is displaceable, at least partially, together with the locking member (4).

8. A chuck according to claim 1, further comprising a manually displaceable, from outside, looking sleeve (11) for displacing the spring (6), the locking sleeve (11) being displaceable one of axially and rotatably.

9. A chuck for a rotary-percussion power tool (2), comprising a working tool guide (3) for receiving a shank (3) of a working tool; at least one locking member (4) for limiting an axial displacement of the shank (5) in opposite directions within an axial displacement length (X); a displaceable stop member (7) cooperating, within the shank displacement length (X), with a power tool side, stop surface (8) of the shank (5); and a spring (6) for biasing the stop member (7) into engagement with the stop surface (8) of the shank (5) and formed as a ring surrounding the stop member (7) and preloaded radially inwardly.

10. A chuck according to claim 9, wherein the spring (6) is supported, at least partially, on a cylindrical guide surface (12) of the working tool guide (3).

11. A chuck according to claim 9, wherein the spring (6) forms an axially projecting, entraining hook (13) formlockingly engageable in a recess (14) of the at least partially pivotally displaceable, locking sleeve (11) for joint rotation therewith.

* * * * *